United States Patent [19]

Stephanus et al.

[11] Patent Number: 4,503,934

[45] Date of Patent: Mar. 12, 1985

[54] DRAIN PLUG WITH DISENGAGEMENT SEALING MEANS

[76] Inventors: Tony L. Stephanus, 2741 E. South St., Columbus, Ind. 47201; Donald J. Stephanus, R.R. 1, Lexington, Ind. 47138

[21] Appl. No.: 483,582

[22] Filed: Apr. 11, 1983

[51] Int. Cl.[3] ..... F16N 33/00; F16K 5/02

[52] U.S. Cl. ..... 184/1.5; 138/89; 251/215

[58] Field of Search ..... 184/1.5, 52; 138/89; 251/216, 215; 220/375; 411/386

[56] References Cited

U.S. PATENT DOCUMENTS

| | | | |
|---|---|---|---|
| 1,753,833 | 4/1930 | Mueller | 251/215 |
| 3,727,638 | 4/1973 | Zaremba et al. | 184/1.5 X |
| 3,811,650 | 5/1974 | Dehar | 184/1.5 X |
| 3,929,250 | 12/1975 | Abbate et al. | 138/89 X |
| 3,948,481 | 4/1976 | Pollock | 184/1.5 X |
| 3,967,697 | 7/1976 | Guenther | 184/1.5 |
| 4,025,048 | 5/1977 | Tibbitts | 184/1.5 X |

*Primary Examiner*—David H. Brown

*Attorney, Agent, or Firm*—Woodard, Weikart, Emhardt & Naughton

[57] ABSTRACT

An oil pan drain plug having a gasket mounted to the tip thereof to limit oil flow. A flexible gasket mounted to the end of the threaded shank of a bolt has an outside diameter sized to prevent oil flow from a hole even though the external threads on the bolt shank are disengaged therefrom. Four embodiments are disclosed wherein the gasket is mounted to a post integrally connected to the bolt shank. Another embodiment includes a thin walled hollow gasket through which a fastener extends securing the gasket to the bolt shank.

1 Claim, 6 Drawing Figures

DRAIN PLUG WITH DISENGAGEMENT SEALING MEANS

BACKGROUND OF THE INVENTION

This invention is in the field of drain plugs and in particular those used in sealing oil pans. Vehicle oil pans include a bottom wall provided with a drain hole having a drain plug removably mounted therein. In order to change the vehicle oil, the drain plug must be removed and the oil within the pan allowed to drain through the hole. As the plug is removed, the hot oil quickly flows through the hole and onto the mechanic's hand untightening and removing the plug from the pan. Disclosed herein is a drain plug having a gasket mounted to the distal end of the plug threaded shank to allow the mechanic to rotatably unloosen the drain plug and then quickly pull along the longitudinal axis of the plug allowing the gasket to temporarily seal the hole prior to removal of the plug and gasket from the hole. As a result, the flow of oil through the hole is temporarily stopped allowing the mechanic to remove the plug as well as his hand from the vicinity of the drain hole.

SUMMARY OF THE INVENTION

One embodiment of the present invention is a plug mountable to an interally threaded hole comprising a main body with an enlarged wrench engageable head and a shank integrally connected together, the shank having external threads thereon and a longitudinal axis extending centrally therethrough, and a gasket mounted to an end of the shank farthest from the head and sized to sealingly engage the internally threaded hole as the external threads are disengaged therefrom limiting drainage through the hole until the main body is pulled in the direction of the axis disengaging the gasket from the hole.

Another embodiment of the present invention is an oil pan with an internally threaded drain hole, a main body with an enlarged wrench engageable head and a shank integrally connected together, the shank having external threads thereon and a longitudinal axis extending centrally therethrough, and a gasket mounted to an end of the shank farthest from the head and sized to sealingly engage the internally threaded hole as the external threads are disengaged therefrom limiting drainage through the hole until the main body is pulled in the direction of the axis disengaging the gasket from the hole.

It is an object of the present invention to provide a new and improved drain plug.

A further object of the present invention is to provide a new and improved combination of oil pan and drain plug wherein the plug is provided with a gasket to temporarily limit the flow of oil from a pan as the plug is removed.

A further object of the present invention is to provide various designs of an oil pan drain plug having disengagement sealing means.

Related objects and advantages of the present invention will be apparent from the following description.

DESCRIPTION OF THE PREFERRED EMBODIMENTS

Figure 1:
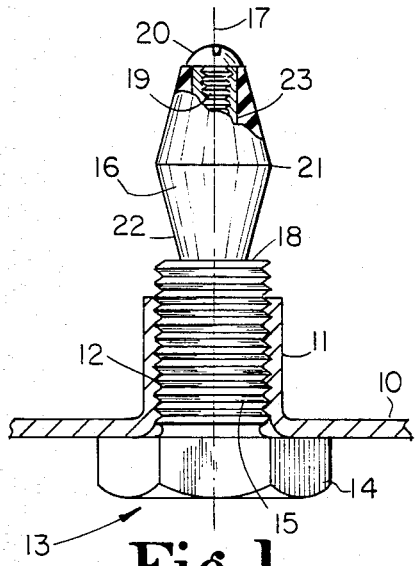
FIG. 1 is a fragmentary cross-sectional view of the bottom wall of an oil pan with the preferred embodiment of the drain plug mounted thereto.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring more particularly to FIG. 1, there is shown the bottom wall 10 of a conventional crankcase oil pan. The bottom wall is produced from sheet metal and is turned inwardly forming a flange 11 surrounding the drain hole having internal threads 12 along the interior length of the flange. Removably mounted to the drain hole is a drain plug 13. The preferred embodiment of drain plug 13 is shown in FIG. 1 with the remaining figures depicting alternate embodiements of the drain plug. It is understood that the alternate drain plugs are removably mounted to an internally threaded hole provided in the bottom wall of a crankcase such as shown for the embodiment of FIG. 1. Further, the present invention contemplates and includes utilization of the various drain plugs disclosed herein with a variety of internally threaded holes in addition to oil pan drainage holes.

Drain plug 13 includes a main body with an enlarged wrench engageable head 14 internally connected to an externally threaded shank 15. Head 14 and shank 15 are of conventional design. For example, head 14 may have a hexagonally shaped configuration. A gasket is mounted to the distal end of shank 15 and is produced from a sufficiently flexible material to allow the gasket to be inserted into the internally threaded oil pan hole to sealingly engage the internal threads provided in the hole. In one embodiment, the gasket 16 was produced from rubber.

Integrally mounted to the distal end 18 of shank 15 is a metal post 19 through which the longitudinal axis 17 of the shank extends. Thus, gasket 16 is provided with a longitudinally extending hole through which post 19 extends. The length of gasket 16 and post 19 along axis 17 are approximately equal. A button head cap screw 20 is threadedly mounted to the outer end of post 19 with the enlarged head of the cap screw abutting against the outer end of the gasket thereby securing the gasket to shank 15. The longitudinal axis 17 extends centrally through shank 15 and post 19 with the gasket centrally positioned and in line with shank 15.

Gasket 16 is formed in the shape of two truncated cones with each cone base positioned adjacent each other along a line of contact 21. Gasket 16 is one integral piece to ensure positive sealing between the gasket and internal threads of the oil pan hole. The end portion 22 of gasket 16 adjacent distal end 18 is reduced in external configuration to prevent interference between the shank external threads, the gasket and the internally threaded hole of the oil pan and to guide and ease removal of the gasket from the oil pan hole. The outside diameter of shank 15 is greater than the outside diameter of end portion 22 of the gasket. Likewise, the opposite end portion 23 is reduced in external size to facilitate insertion and removal of the gasket relative to the oil pan hole. The largest external portion of the gasket exists along the line of contact 21 with the outside diameter of the gasket existing at line of contact 21 being greater than the inside diameter of the internally threaded oil pan hole preventing oil drainage through the hole whenever the gasket along the line of contact 21 is engaged with the internal threads of the hole.

When inserting the drain plug, the mechanic first forces the gasket into the hole until the external threads on the shank 15 contact the internal threads of the oil pan hole. The plug is then rotated in a conventional manner until the plug is completely tightened. When removing the plug, the plug is rotated until the external threads are disengaged from the internal threads of the oil pan hole. The distance between distal end 18 of shank 15 and line of contact 21 is not greater than the depth of the oil pan hole. Thus, once the external threads of the shank are disengaged from the hole, the line of contact on the gasket is automatically engaged with the internally threaded hole preventing oil drainage. The mechanical may then grasp the enlarged head of the plug and pull downwardly along axis 17 until the gasket is completely removed from the hole. The downward momentum of the plug allows the mechanic to continue moving the plug rapidly away from the oil pan ensuring that the hot oil does not drip onto the mechanic's hand.

Figure 2:
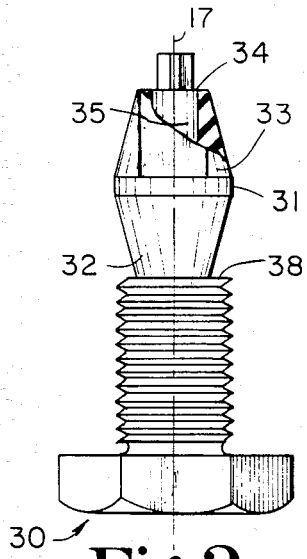
FIG. 2 is a fragmentary side view of an alternate embodiment of the drain plug.

An alternate embodiment of the drain plug is shown in FIG. 2. Drain plug 30 is identical to the preferred embodiment shown in FIG. 1 with the exception that the line of contact 21 has been replaced by an area of contact or a flat surface 31 which extends along the direction of the longitudinal axis 17. Further, the button head cap screw 20 is replaced by a plurality of arms which are flattened against the gasket. Gasket 32 is fragmented at area 33 as is gasket 16 in order to illustrate the post and mounting arrangement of the gasket to the plug shank. It is to be understood that both gasket 32 and gasket 16 extends completely from the plug shank up to the outer distal end of the interior posts. Flat surface 31 provides increased sealing means between the gasket and the internal threads as compared to the line of contact 21 for plug 13. The distal end 34 of post 35 is split into multiple arms 35, 36, 37 and 38 which initially extend in the direction of axis 17. Once gasket 32 is mounted to post 35, the four arms are cold formed by bending downwardly against the gasket thereby securing the gasket to the post. As described for drain plug 13, the distance between flat surface 31 and the distal end 38 of the threaded plug shank is not greater than the depth of the oil pan threaded hole to ensure that flat surface 31 sealingly engages the internally threaded oil pan hole prior to disengagement of the external threads on the plug shank from the internal threads on the oil pan hole.

Figure 4:
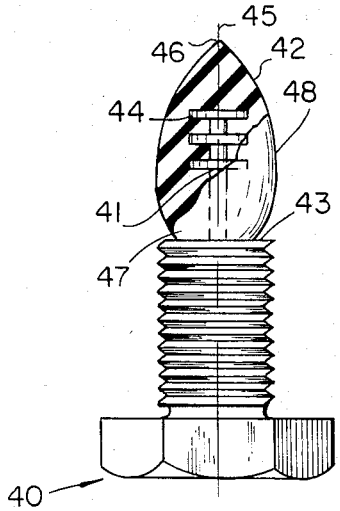
FIG. 4 is a fragmentary side view of a further embodiment of the drain plug.

A further embodiment of the drain plug is shown as plug 40 in FIG. 4. The head and shank of the plug is the same as previously described; however, post 41 and gasket 42 are slightly different as compared to what has previously been described. Post 41 is integrally mounted to the distal end 43 of the plug shank and includes a plurality of arms 44 extending outwardly therefrom in a direction other than the longitudinal axis 45 of the plug. In the embodiment shown in FIG. 4, arms 44 are disc configured to allow gasket 42 to be molded thereon alleviating the necessity for an external fastening device to secure the gasket to the post. Gasket 42 is tear drop in configuration having an outer tip 46 to allow easy insertion and removal of the gasket into the internally threaded oil pan hole. Likewise, the opposite end 47 of the gasket is sized smaller than the outside diameter of the threaded shank of the plug to prevent interference between the gasket, shank, external threads and the internally threaded hole. The central portion 48 of the gasket is enlarged in size and has an outside diameter slightly greater than the inside diameter of the oil pan hole to sealingly engage the hole as the plug is removed therefrom. Again, the distance between distal end 43 of the plug shank and the central portion 48 of the gasket is equal to or less than the depth of the oil pan hole to ensure sealing engagement between the gasket and oil pan hole as the external shank threads of the plug are disengaged from the hole.

Figure 5:
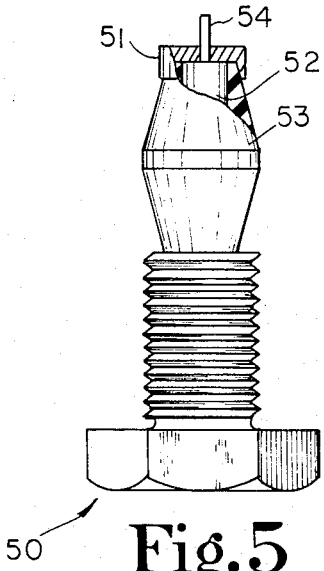
FIG. 5 is a fragmentary side view of yet a further embodiment of the drain plug.
Figure 3:
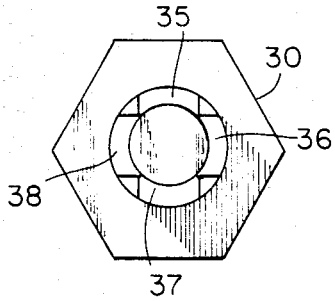
FIG. 3 is a top end view of the plug of FIG. 2.

A further embodiment of the drain plug is shown in FIG. 5. Drain plug 50 is identical to the plug shown in FIG. 2 with the exception that arms 35–38 have been replaced by a cap 51 mounted to the distal end of post 52. A projection 54 is integrally connected to post 52 and extends through cap 51. Once the gasket 53 is mounted to the post and the cap 51 is mounted to the post, extension 54 is flattened against the cap thereby securing the cap and gasket to the post. The gasket mounted to plug 50 has a flat area of contact such as previously described for gasket 32.

Figure 6:
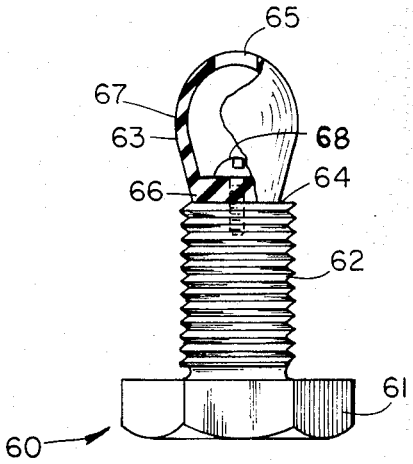
FIG. 6 is a fragmentary side view of another embodiment of the drain plug.

Another embodiment of the drain plug is shown in FIG. 6. Drain plug 60 is different from the drain plugs previously described in that a post is not provided for mounting of the gasket. Plug 60 includes an enlarged head 61 and externally threaded shank 62 identical to the plugs previously described. A threaded screw 68 extends through gasket 63 and into the distal end 64 of shank 62 mounting the gasket to the shank. Gasket 63 is hollow with an outwardly opening distal end 65 and a closed flat proximal end 66. The gasket is a thin walled structure and is inwardly collapsible to ease insertion and removal relative to the internally threaded oil pan hole. In order to mount the gasket to the shank, fastener 68 is slipped through hole 65 and threaded into shank 62. End 66 of the gasket has an outside diameter smaller than the outside diameter of the shank to prevent interference between the gasket, shank and oil pan hole. Further, the middle or center portion 67 of the gasket is enlarged slightly greater than the diameter of the internally threaded oil pan hole to ensure sealing contact therebetween.

The design disclosed herein allows for a tapered plug made of a heat and oil resistant material to be affixed to the internal end of the bolt. The plug seats in the uppermost part of the oil pan internal threads as the bolt is removed. By producing the gasket mounting post from a magnetic material, metal particles within the oil will be attracted and retained by the plug. Further, a thermal guard material may be provided on the head of the plug to allow the mechanic to handle the plug without further protection.

It will be obvious from the above description that the present invention provides many advantages. First, the gasket acts as a pilot to eliminate cross threading between the threaded shank and internally threaded oil pan hole. The plug is particularly advantageous in that oil mess is completely eliminated allowing the operator to handle the plug without oil running onto his hands. Further, the plug disclosed herein allows the operator to change the oil in a hot condition while maximizing safety.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. A plug mountable to an internally threaded hole comprising:

a main body with a tool engageable head and a shank integrally connected together, said shank having external threads thereon and a longitudinal axis extending centrally therethrough;

a gasket mounted to an end of said shank farthest from said head and sized to sealingly engage said internally threaded hole as said external threads are disengaged therefrom limiting drainage through said hole until said main body is pulled in the direction of said axis disengaging said gasket from said hole;

a post mounted to said of said shank and extending away therefrom in the direction of said axis, said post providing a mount for said gasket, said post includes arms extending outwardly in a direction other than said axis to secure said gasket thereon.

* * * * *